US009302511B2

(12) United States Patent
Yoshida et al.

(10) Patent No.: US 9,302,511 B2
(45) Date of Patent: Apr. 5, 2016

(54) SHEET CUTTING APPARATUS AND PRINTER, AND SHEET HANDLER PROVIDED THEREWITH

(71) Applicant: CANON KABUSHIKI KAISHA, Tokyo (JP)

(72) Inventors: Masahito Yoshida, Shiki (JP); Hikaru Watanabe, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/655,275

(22) Filed: Oct. 18, 2012

(65) Prior Publication Data

US 2013/0101330 A1 Apr. 25, 2013

(30) Foreign Application Priority Data

Oct. 21, 2011 (JP) ..... 2011-232050

(51) Int. Cl.

| | |
|---|---|
| ***B26D 7/18*** | (2006.01) |
| ***B41J 11/66*** | (2006.01) |
| ***B41J 15/04*** | (2006.01) |
| *B26D 7/00* | (2006.01) |
| *B26D 1/08* | (2006.01) |
| *B26D 5/32* | (2006.01) |

(52) U.S. Cl.

CPC . *B41J 11/66* (2013.01); *B26D 7/18* (2013.01); *B26D 7/1854* (2013.01); *B26D 7/1863* (2013.01); *B41J 15/04* (2013.01); *B26D 1/085* (2013.01); *B26D 5/32* (2013.01); *B26D 2007/0018* (2013.01)

(58) Field of Classification Search

CPC ..... B41J 11/66; B41J 11/70; B41J 11/663; B41J 29/377; B26D 7/18; B26D 7/1854; B26D 7/1863; B26D 2007/18

USPC ..... 400/621

See application file for complete search history.

(56) References Cited

U.S. PATENT DOCUMENTS

| | | | | |
|---|---|---|---|---|
| 5,672,452 | A * | 9/1997 | Kanbayashi et al. | 430/45.1 |
| 6,042,228 | A * | 3/2000 | Yamada et al. | 347/104 |
| 7,133,626 | B2 * | 11/2006 | Kaiga et al. | 399/110 |
| 7,139,522 | B2 * | 11/2006 | Ohki et al. | 399/384 |
| 7,461,578 | B2 * | 12/2008 | Tamura et al. | 83/147 |
| 8,011,282 | B2 * | 9/2011 | Yoshimaru | 83/100 |
| 8,525,860 | B2 * | 9/2013 | Ishii et al. | 347/214 |
| 8,657,219 | B2 * | 2/2014 | Sato | 241/100 |
| 8,682,240 | B2 * | 3/2014 | Fukita et al. | 399/405 |
| 2011/0211900 | A1 * | 9/2011 | Ueda et al. | 400/621 |

FOREIGN PATENT DOCUMENTS

| | | | | |
|---|---|---|---|---|
| JP | H07-172080 | A | 7/1995 | |
| JP | 2000-335028 | A | 12/2000 | |
| JP | 2001253586 | A * | 9/2001 | B65H 5/38 |

* cited by examiner

*Primary Examiner* — Justin Olamit

(74) *Attorney, Agent, or Firm* — Canon USA, Inc. IP Division

(57) ABSTRACT

A sheet cutting apparatus includes a cutting unit configured to cut a sheet, a discharge unit configured to discharge a fragment of the sheet cut by the cutting unit, a blowing unit configured to blow air on the fragment discharged from the discharge unit, and a storage unit configured to store the fragment discharged from the discharge unit.

22 Claims, 18 Drawing Sheets

SHEET CUTTING APPARATUS AND PRINTER, AND SHEET HANDLER PROVIDED THEREWITH

BACKGROUND OF THE INVENTION

1. Field of the Invention

Aspects of the present invention relate to a sheet cutting apparatus that cuts off an unwanted portion from a sheet on which an image is formed, thereby producing a print product of intended size, and a printer.

2. Description of the Related Art

Conventional printers that can produce a single sheet-like print product are broadly classified into ones that form an image on a medium having the product's intended size and ones that form an image on a medium larger than the intended size, thereby cutting off unwanted portions to obtain the intended size.

The latter apparatuses which form an image before cutting include large-scale ones that are capable of producing a single-sheet product from a rolled continuous sheet. Such apparatuses include a sheet conveyance unit and a cutting unit inside, and perform separation between the product and unwanted portions inside the apparatus.

For the purpose of disposal of unwanted portions, the unwanted portions are typically desired to be efficiently stored in an unwanted portion storage container inside the apparatus.

The cutting unit produces paper dust during cutting. Consideration needs to be given to avoiding adhesion of paper dust to a print product and maintaining the cutting performance.

Japanese Patent Application Laid-Open No. 2000-335028 discusses a technique in which a container for storing fragments is arranged under the cutting unit so that falling fragments are stored in the container. The bottom of the container is configured with a filter, and a fan is arranged under the filter. The suction force of the fan is used to capture cut wastes and paper dust by the filter.

To store falling fragments according to Japanese Patent Application Laid-Open No. 2000-335028, the container for storing the fragments is arranged under the cutting unit. The container therefore may not always be located in a position accessible to the user. Since cut wastes and paper dust are captured by the filter, the filter can become clogged up and the fan's suction force varies easily as more and more wastes are stored.

SUMMARY OF THE INVENTION

Aspects of the present invention relate to improving the degree of freedom of the arrangement of the storage unit that stores cut sheet fragments.

According to an aspect of the present invention, a sheet cutting apparatus includes a cutting unit configured to cut a sheet, a discharge unit configured to discharge a fragment of the sheet cut by the cutting unit, a blowing unit configured to blow air on the fragment discharged from the discharge unit, and a storage unit configured to store the fragment discharged from the discharge unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An exemplary embodiment of an inkjet printer will be described below. The printer according to the present exemplary embodiment is a high-speed line printer that uses a rolled continuous sheet. Such a printer is suited to the field of producing a large number of prints in a printing studio, for example.

Figure 1:
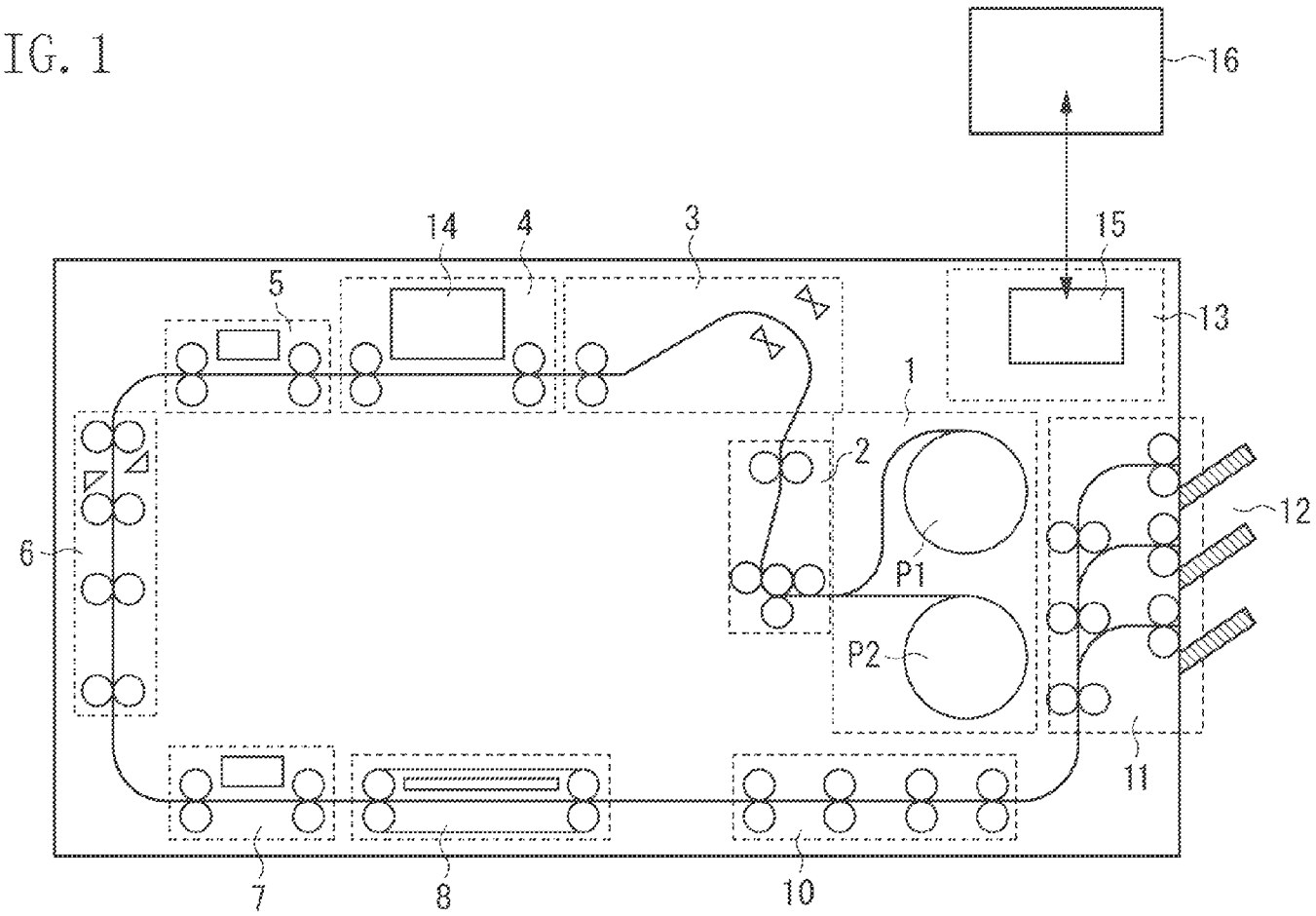
FIG. 1 is a schematic sectional view illustrating the internal configuration of a printer that includes a sheet cutting apparatus according to an exemplary embodiment.

FIG. 1 is a schematic sectional view illustrating the internal configuration of the printer. The printer includes the following units: a sheet supply unit 1, a decurling unit 2, a skew correction unit 3, a print unit 4, an examination unit 5, a sheet cutting and conveyance unit 6, an information recording unit 7, a drying unit 8, a discharge conveyance unit 10, a sorter unit 11, discharge trays 12, and a control unit 13. A conveyance mechanism including roller pairs and belts conveys a sheet along the sheet conveyance route illustrated by the solid line in the diagram, whereby the sheet is processed by each of the units.

The sheet supply unit 1 is a unit that stores and supplies a rolled continuous sheet or sheets. The sheet supply unit 1 can accommodate two rolls P1 and P2. The sheet supply unit 1 is configured to draw out and supply a sheet from either one of the rolls P1 and P2. The number of rolls to be accommodated is not limited to two. The sheet supply unit 1 may accommodate one roll or more than two rolls.

The decurling unit 2 is a unit that eases curl (warpage) of the sheet supplied from the sheet supply unit 1. The decurling unit 2 uses a driving roller and two pinch rollers to curve and strain the sheet to give warpage reverse to the curl, thereby easing the curl.

The skew correction unit 3 is a unit that corrects a skew (an inclination with respect to the original traveling direction) of the sheet past the decurling unit 2. The skew correction unit 3 presses a referential end of the sheet against a guide member to correct the skew of the sheet.

The print unit 4 is a unit that forms an image on the conveyed sheet by using a print head 14. The print unit 4 includes a plurality of conveyance rollers for conveying the sheet. The print head 14 includes line print heads in which inkjet nozzles are formed in rows in the range of covering the maximum possible width of a sheet for use. The print head 14 includes a plurality of print heads that are arranged in parallel along the conveyance direction. Inkjet printing may employ such methods as using heating elements, using piezoelectric elements, using electrostatic elements, or using micro-electro-mechanical systems (MEMS) elements. Color inks are supplied to the print head 14 from ink tanks through respective ink tubes.

The examination unit 5 is a unit that optically reads an examination pattern and/or an image printed by the print unit 4 on the sheet, and examines the state of the nozzles of the print head 14, the state of sheet conveyance, and an image position.

The sheet cutting and conveyance unit 6 is a unit that includes mechanical cutters for cutting the printed sheet into a predetermined length. The sheet cutting and conveyance unit 6 includes a plurality of conveyance rollers for sending the sheet to the next step, and a space for storing dust generated by cutting. The sheet cutting and conveyance unit 6 also includes a sheet cutting apparatus.

The drying unit 8 is a unit that heats the sheet printed by the print unit 4 to dry the applied inks in a short time. The drying unit 8 includes a heater as well as a conveyance belt and conveyance rollers for sending the sheet to the next step.

The discharge conveyance unit 10 is a unit for conveying the sheet that is cut by the sheet cutting and conveyance unit 6 and dried by the drying unit 8 and passing the sheet to the sorter unit 11. The sorter unit 11 is a unit that sorts printed sheets of each group into different trays 12 to discharge the sorted sheets if necessary.

The control unit 13 is a unit that controls each of the units of the entire printer. The control unit 13 includes a controller 15 and a power supply. The controller 15 includes a central processing unit (CPU), a memory, and various types of input-output (I/O) interfaces. The control unit 13 controls the printer operation based on instructions from the controller 15 or an external device 16, such as a host computer, that is connected to the controller 15 through the I/O interfaces.

Figure 2:
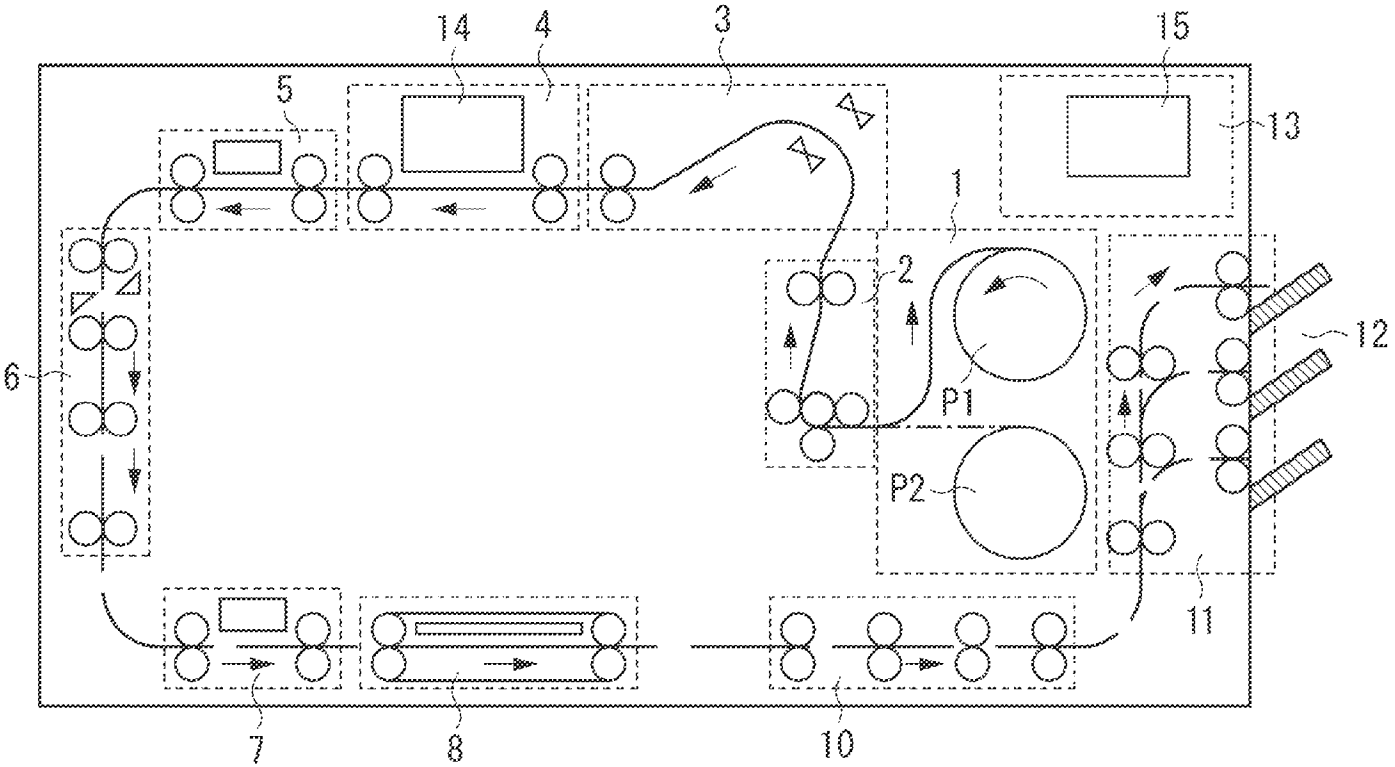
FIG. 2 is a schematic diagram illustrating the operation of the printer that includes the sheet cutting apparatus according to the exemplary embodiment.

FIG. 2 is a schematic diagram for describing the operation of the printer. The thick lines indicate the conveyance route through which a sheet supplied from the sheet supply unit 1 is printed and discharged to a discharge tray 12. The sheet supplied from the sheet supply unit 1 is processed by the decurling unit 2 and the skew correction unit 3, and printed on the surface by the print unit 4. The printed sheet is passed through the examination unit 5 and cut into preset, predetermined unit lengths by the sheet cutting and conveyance unit 6. The cut sheets are conveyed to the drying unit 8 one by one for drying. The sheets are then passed through the discharge conveyance unit 10, and discharged to and stacked on the trays 12 of the sorter unit 11 in succession.

Figure 3:
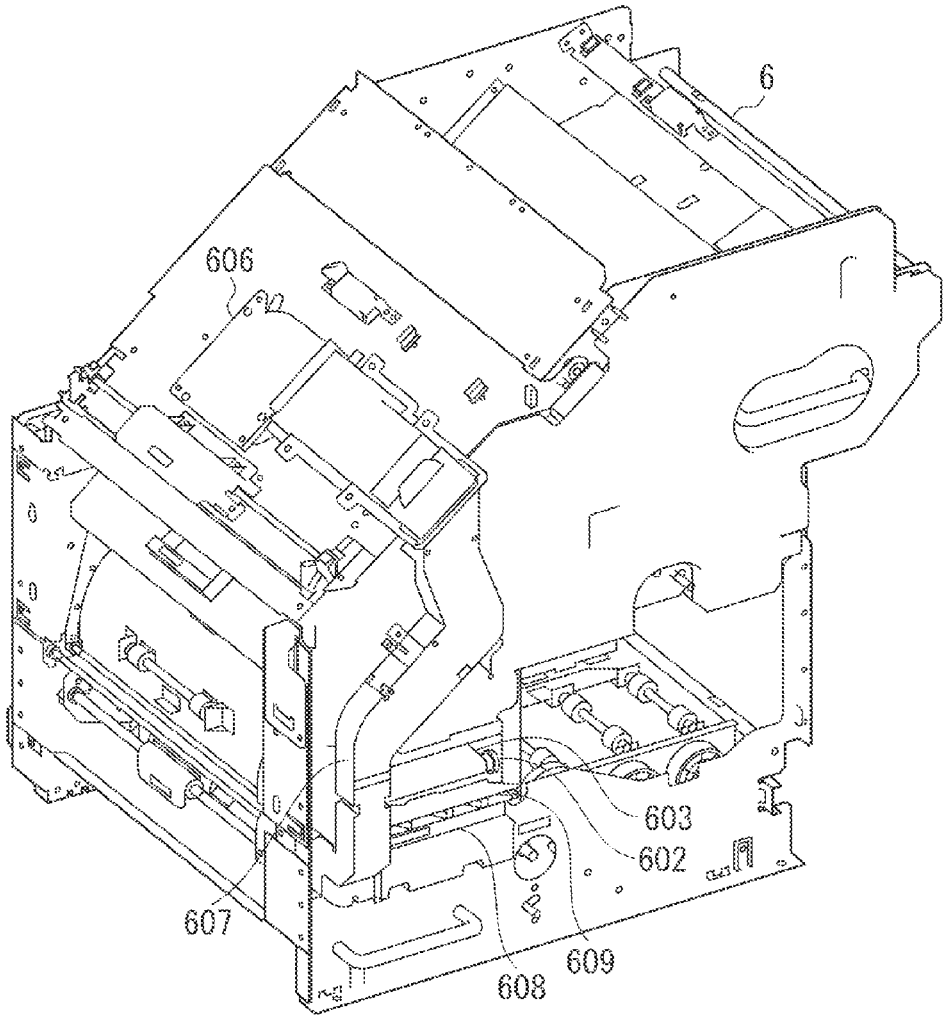
FIG. 3 is a schematic perspective view of a sheet cutting and conveyance unit which includes the sheet cutting apparatus according to the first exemplary embodiment.
Figure 4:
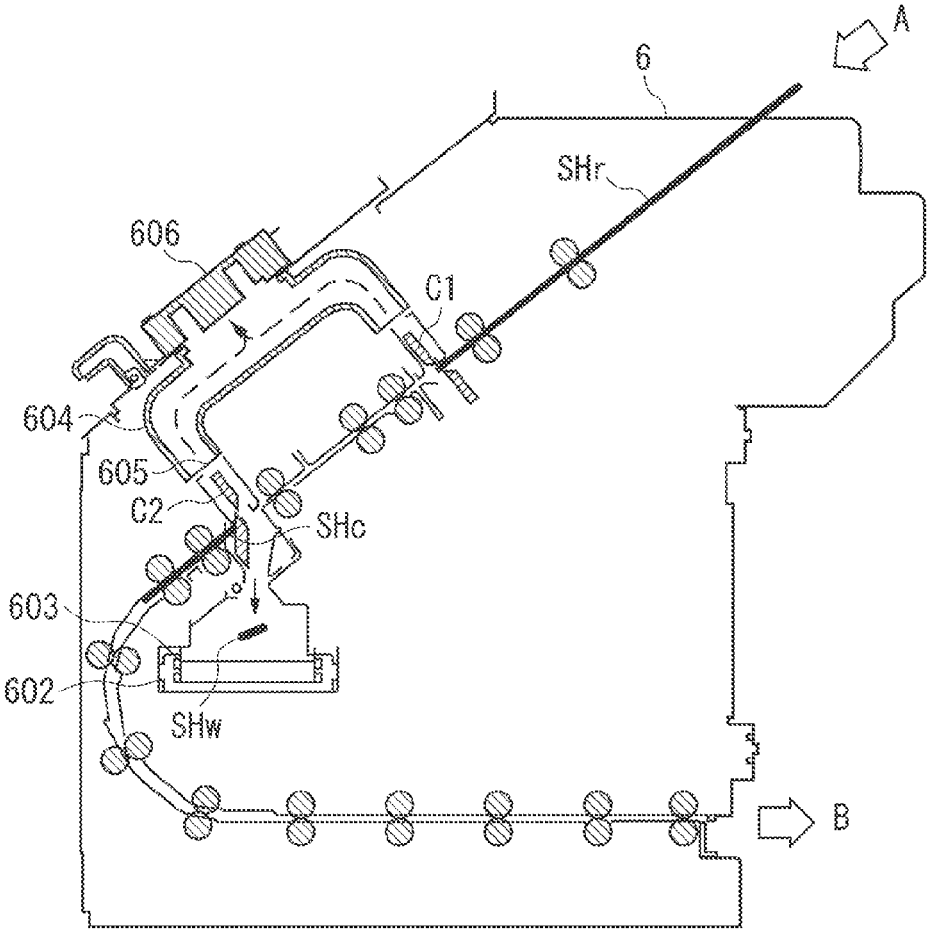
FIG. 4 is a schematic sectional view illustrating the configuration of the sheet cutting and conveyance unit.

The exemplary embodiment of the sheet cutting and conveyance unit 6 including the sheet cutting apparatus will be described in more detail below. FIG. 3 is a schematic perspective view of the sheet cutting and conveyance unit 6. FIG. 4 is a schematic perspective view illustrating the configuration of the sheet cutting and conveyance unit 6. In FIG. 4, a sheet conveyance path 601 takes a route that extends obliquely from the upper right side A to the lower left, bends below, and returns to the right side B below.

The sheet conveyance path 601 includes cutter units C1 and C2 as a cutting unit for cutting a continuous sheet. The cutter units C1 and C2 are a slide cutter each, including a movable blade arranged above the sheet path 601 and a fixed blade arranged below. The movable blades and the fixed blades have a length greater than or equal to the sheet width.

The conveyed sheet is temporarily stopped for cutting. After the cutting, the sheet is conveyed to the next step at higher speed for the sake of compensation for the stop time.

To suck paper dust occurring during cutting, suction ports 605 are arranged above and near the first cutter unit C1 and the second cutter unit C2. The suction ports 605 are connected to a fan 606 through a suction duct 604. The fan 606 is a fan that has high flow rate.

Figure 5:
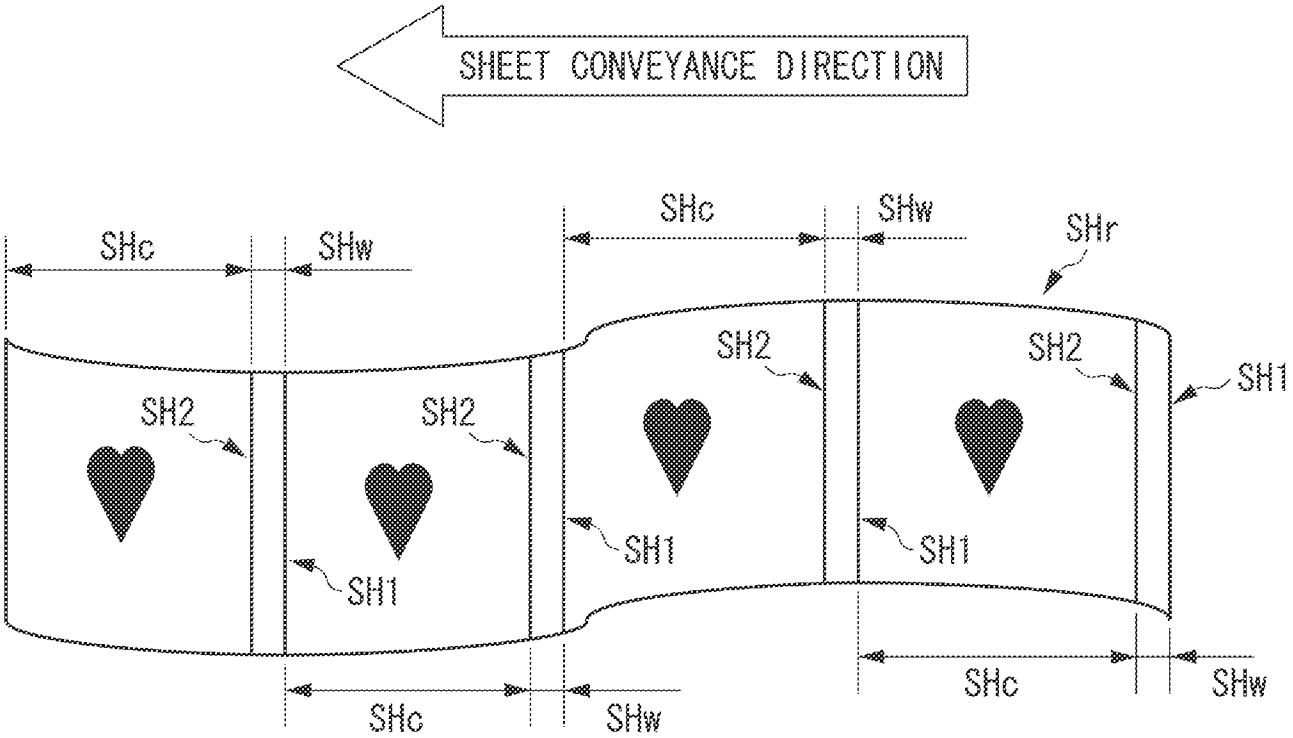
FIG. 5 illustrates an example of images formed on an uncut continuous sheet.

FIG. 5 illustrates an example of images formed on an uncut continuous sheet according to an exemplary embodiment of the present invention. Products SHc and unwanted portions SHw are alternately printed one by one on the conveyed continuous sheet SHr. The products SHc are the portions to be final print products. To cut and produce a product SHc out of the continuous sheet SHr, the first cutter unit C1 initially cuts the leading end, SH1, of the product SHc. This creates a product SHc accompanied by an unwanted portion SHw at the trailing end. The second cutter unit C2 then cuts the trailing end, SH2, of the product SHc to complete the production of the product SHc. The thin waste SHw having the same length as the sheet width of the continuous sheet SHr is allowed to fall down.

Figure 6A:
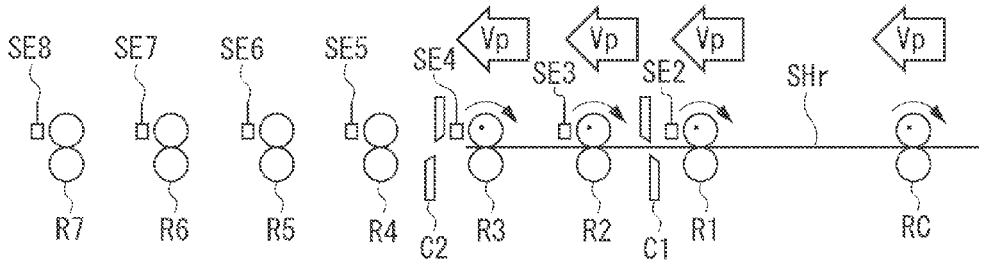
FIGS. 6A, 6B, 6C, and 6D are diagrams illustrating the operation of the sheet cutting apparatus.

The operation of the sheet cutting apparatus will be described with reference to FIGS. 6A, 6B, 6C, 6D, 7A, 7B, 7C, and 7D. FIG. 6A illustrates the state up to when the printed sheet reaches a cut position. The uncut continuous sheet SHr continuously conveyed from upstream at a conveyance speed Vp passes between conveyance roller pairs R1, R2, and R3, which rotate at the same conveyance speed, before and after the first cutter unit C1 to reach the cut position. The cut position may be determined, for example, by detecting the leading edge of the sheet by an edge sensor SE2 after passing the roller pair R1, and determining the length after passing between the blades of the first cutter unit C1 by the conveyance amount of the conveyance roller pair R1 after the detection. An image sensor separate from the edge sensor SE2 maybe used to detect the formed image to determine the cut position.

Figure 6B:
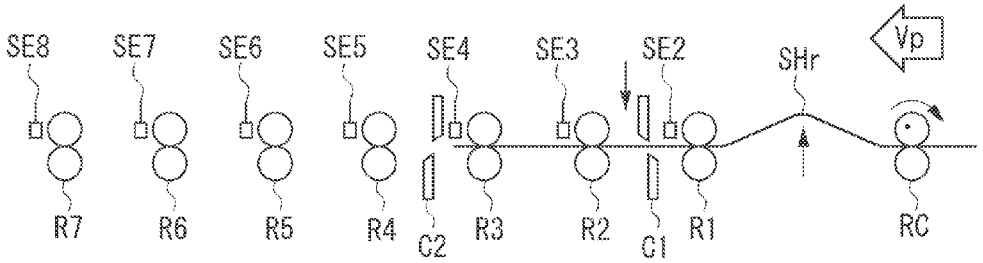

FIG. 6B illustrates the state when the first cutter unit C1 is cutting the continuous sheet SHr in the cut position SH1. The roller pairs R1, R2, and R3 pinching the continuous sheet SHr are stopped to hold the sheet while the first cutter unit C1 is in operation. The uncut continuous sheet SHr on which images are printed continues being conveyed from upstream even while the sheet is stopped by the first cutter unit C1. The uncut continuous sheet SHr is retained in a loop-like shape upstream of the conveyance roller pair R1.

Figure 6C:
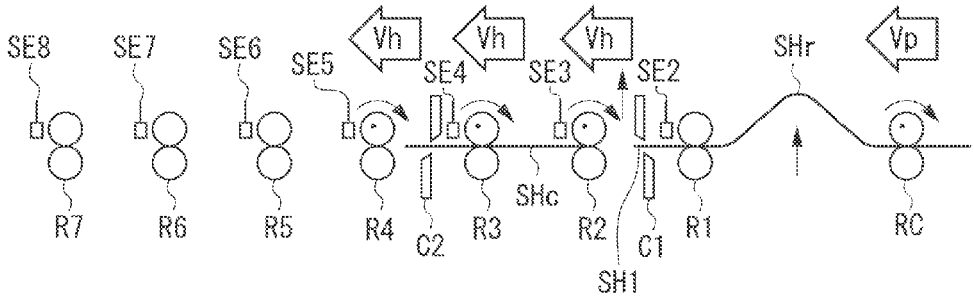

FIG. 6C illustrates the state immediately after the completion of the cutting by the first cutter unit C1. After the completion of the cutting, the cut print product SHc is conveyed at a speed Vh higher than the conveyance speed Vp of the continuous sheet SHr to resolve the loop-like retention and prevent the uncut continuous sheet SHr and the print product SHc from overlapping. While the conveyance roller pair R1 on the continuous sheet side are kept stopped, the conveyance roller pairs R2, R3, and R4 are driven at the conveyance speed Vh to start conveying the cut product SHc accompanied by a unwanted portion SHw to the cut position of the second cutter unit C2.

Figure 6D:
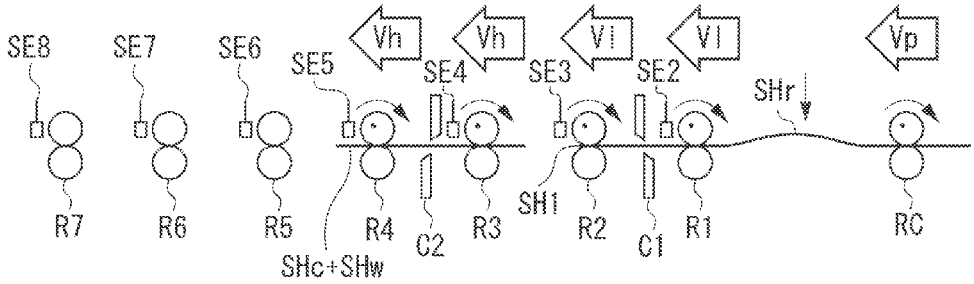

FIG. 6D illustrates the state when a short time has elapsed immediately after the conveyance of the print product SHc accompanied by the unwanted portion SHw at the trailing end at Vh. To resolve the loop of the continuous sheet SHr that has been retained while the conveyance roller pair R1 is stopped, the conveyance roller pairs R1 and R2 cooperate to convey the continuous sheet SHr at a speed V1 by a predetermined loop-resolving length from the first cutter unit C1. V1 is determined on the condition that the print product SHc and the leading edge of the continuous sheet SHr do not overlap each other and V1>Vp.

Figure 7A:
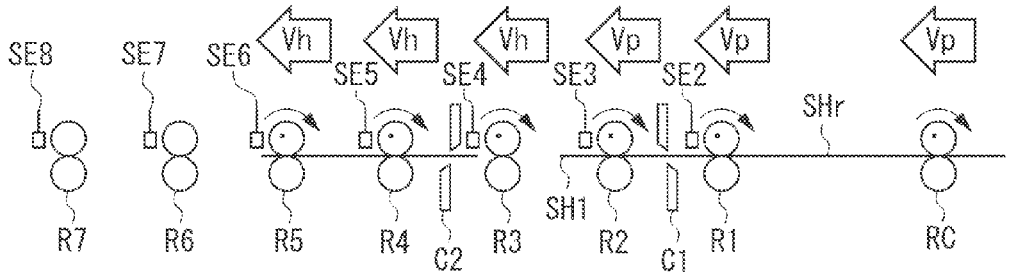
FIGS. 7A, 7B, 7C, and 7D are diagrams illustrating the operation of the sheet cutting apparatus.

FIG. 7A illustrates the state where the print product SHc accompanied by the unwanted portion SHw reaches the cut position of the second cutter unit C2. An edge sensor SE4 detects the leading edge of the sheet SHc+SHw conveyed at the conveyance speed Vh after the cutting by the first cutter unit C1. The length past between the blades of the second cutter unit C2, i.e., the cut position can be determine by the amount of rotation of the conveyance roller pair R4 after the detection. Like the first cutter unit C1, an image sensor separate from the edge sensor SE4 may be used to detect the formed image to determine the cut position.

Figure 7B:
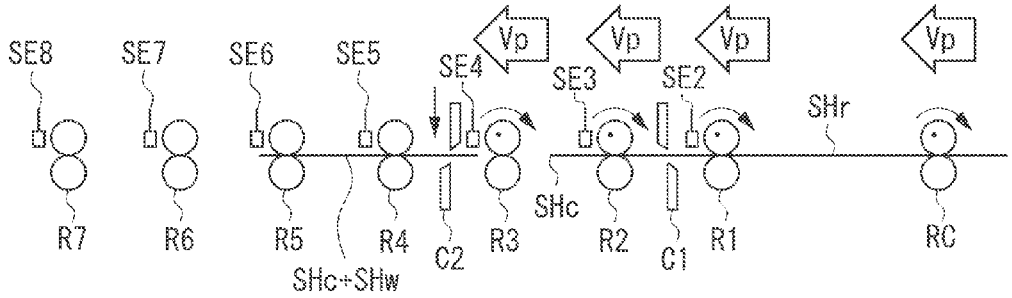

FIG. 7B illustrates the state when the second cutter unit C2 is cutting the sheet SHc+SHw in the cut position SH2. The print product SHc cut by the first cutter unit C1, accompanied by the unwanted portion SHw, is pinched and stopped by the roller pairs R4 and R5 downstream of the second cutter unit C2. The roller pairs R4 and R5 hold the sheet SHc+SHw while the second cutter unit C2 is in operation. The unwanted portion SHw lying upstream of the second cutter unit C2 is separated with cutting, and expelled from the sheet conveyance path by a gravitational free fall and by a unit that uses airflow as an aid.

Figure 7C:
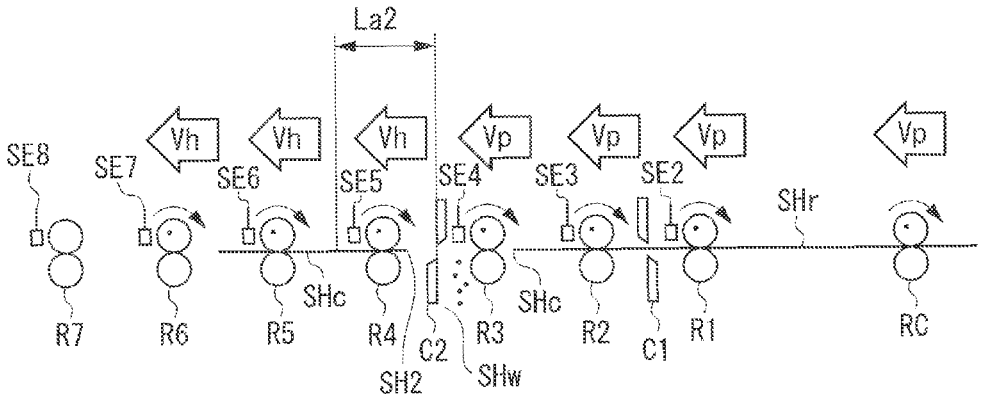

FIG. 7C illustrates the state immediately after the completion of the cutting by the second cutter unit C2. After the completion of the cutting by the second cutter unit C2, the conveyance roller pairs R4, R5, and R6 convey the print product SHc at the speed Vh higher than the conveyance speed Vp of the continuous sheet SHr by a predetermined length La2. The reason is to prevent the print product SHc from overlapping with the next print product SHc that is cut by the cutter C1 and conveyed from upstream at the high fleeing speed Vh.

Figure 7D:
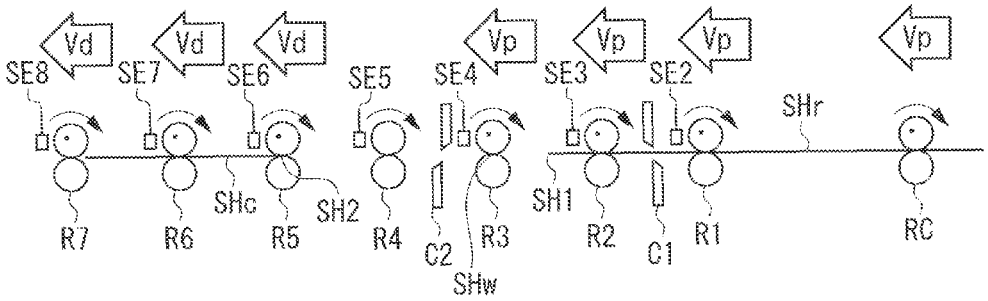

FIG. 7D illustrates the state subsequent to that of FIG. 7C. The conveyance roller pairs R5 and R6 convey the print product SHc at a speed Vd that is needed for the drying unit 8. The conveyance roller pair R4 from which the print product SHc is separated returns to the state of FIG. 6A to repeat conveyance.

Figure 8:
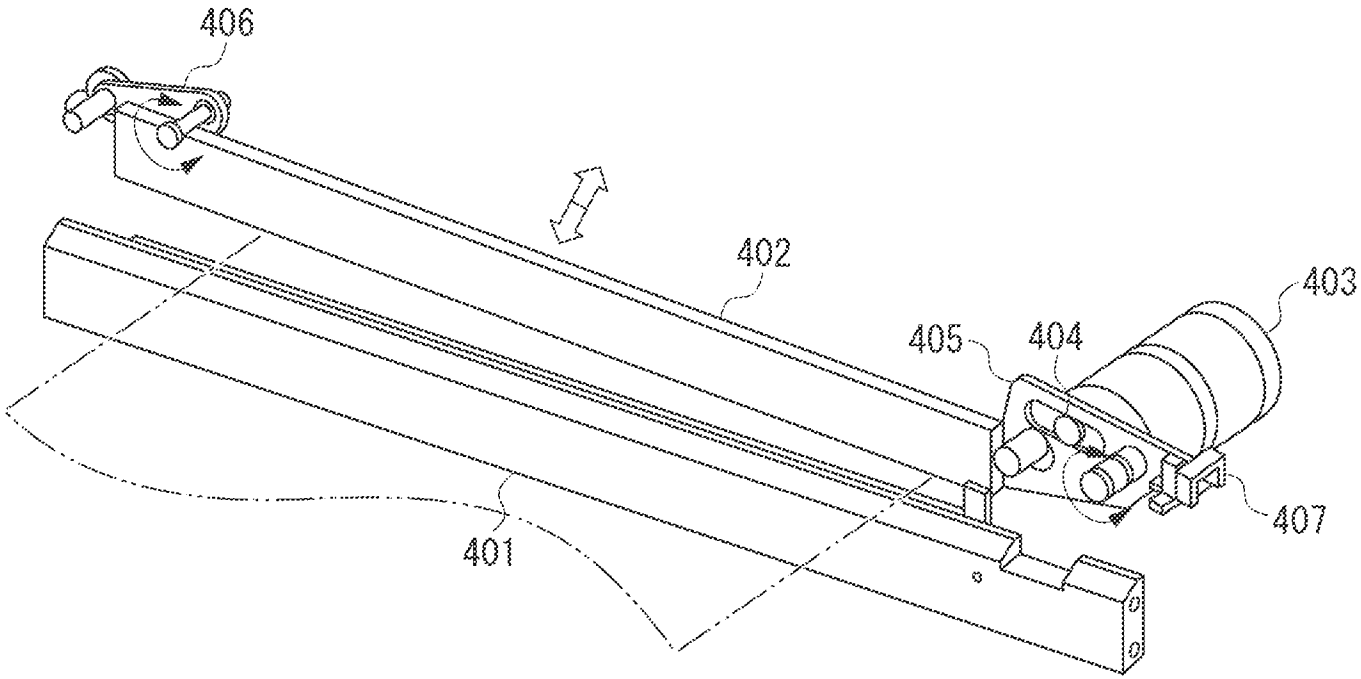
FIG. 8 is a perspective view illustrating cutter units.

FIG. 8 is a schematic diagram illustrating the configuration of the first and second cutter units C1 and C2 included in the sheet cutting and conveyance unit 6. The first and second cutter units C1 and C2 are typically referred to as a slide type, each including a fixed blade 401 and a movable blade 402. The movable blade 402 is driven by a cutter motor 403, the drive source. The movable blade 402 moves up and down via a cam 404, a driving link 405, and a driven link 406 while obliquely abutting on the fixed blade 401. The top dead center where the movable blade 402 rises the farthest from the fixed blade 401 is the position where a medium is guided into between the cutter blades during normal conveyance. The bottom dead center where the movable blade 402 comes to the bottom is the position where the medium is surely and completely cut. Since the cutting load can vary greatly depending on medium conditions, a direct-current (DC) motor is used for the cutter motor 403. A cutter sensor 407 detects the position of the movable blade 402. The terminals across the DC motor is directly connected according to the detection timing for short-circuit braking to stop the cutter motor 403, thereby realizing high-speed movement and stop control. The cutter sensor 407 is typically arranged to stop the cutter motor 403 at the top dead center. A similar sensor may be added to stop the cutter motor 403 at the bottom dead center.

Figure 9:
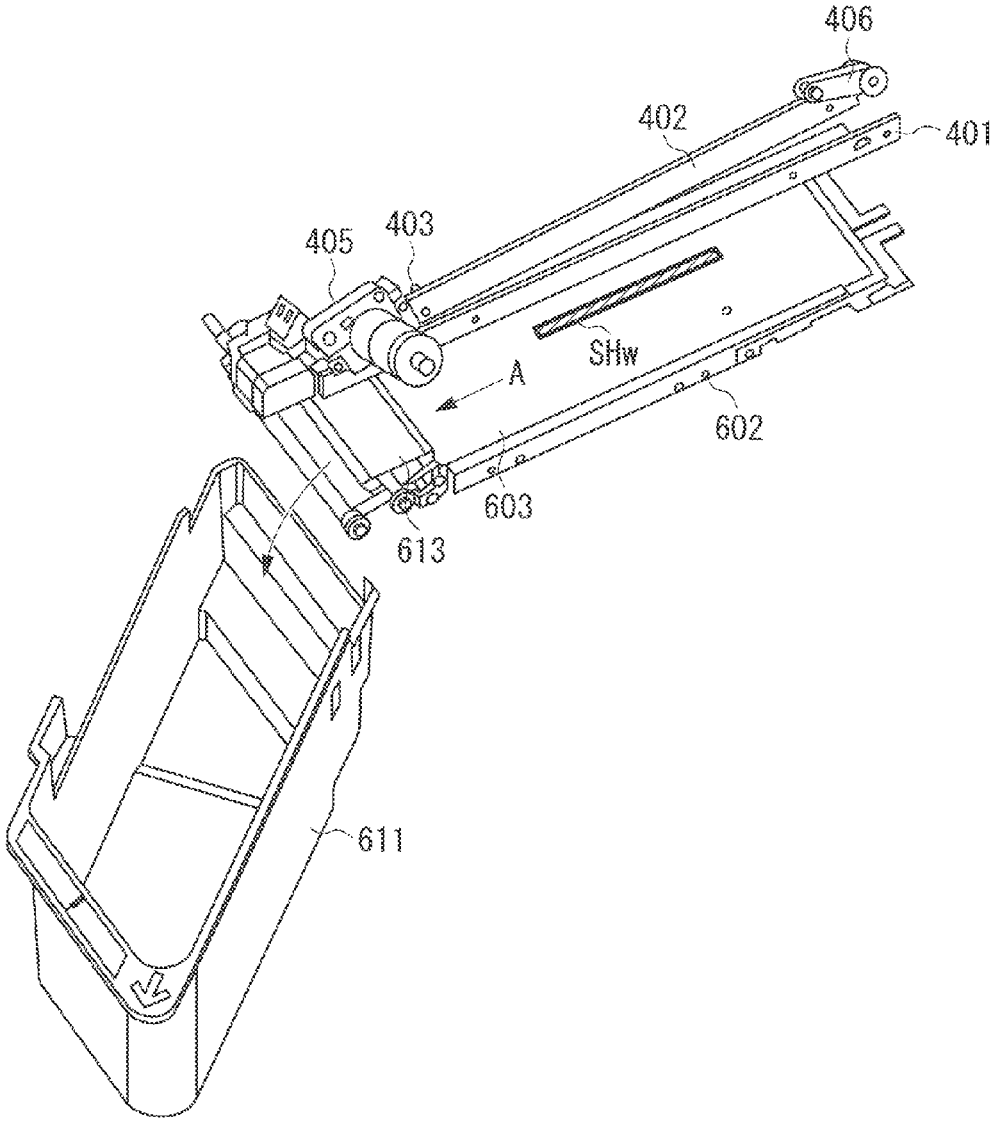
FIG. 9 is a perspective view illustrating the cutter unit and a belt unit.
Figure 10:
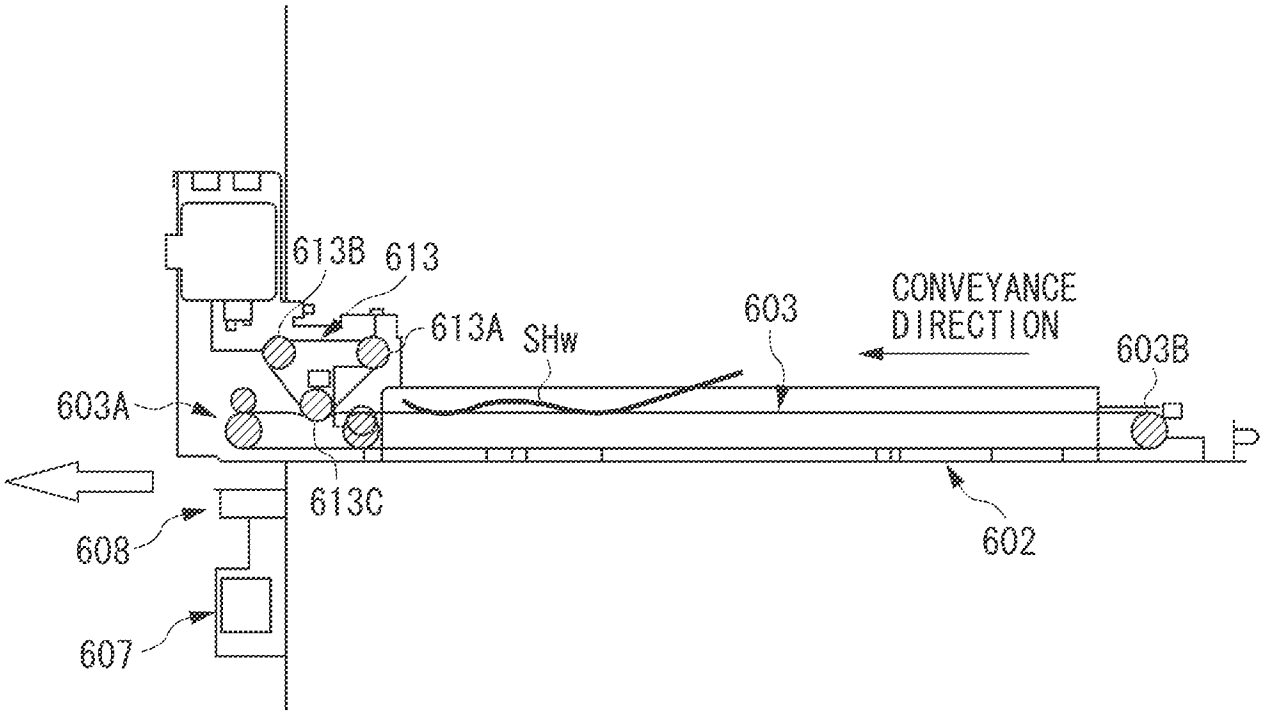
FIG. 10 is a schematic sectional view of the belt unit.

Next, a belt unit 602 will be described. FIG. 9 is a perspective view illustrating the second cutter unit C2 and a belt unit 602. FIG. 10 is a schematic diagram illustrating the belt unit 602 according to an exemplary embodiment of the present invention. The belt unit 602 is arranged under the second cutter unit C2. A conveyance belt 603 carries dropped wastes in a direction at right angles to the conveyance direction.

The conveyance belt 603 conveys the fragments of unwanted portions from the sheet cutting apparatus to an unwanted portion storage container 611. The conveyance belt 603 is supported by pulleys 603A and 603B. A belt motor rotates the driving pulley 603B, which drives the conveyance belt 603. A pinching belt 613 is supported by rotatably-supported pulleys 613A, 613B, and 613C. The pinching belt 613 comes into contact with the downstream end of the conveyance belt 603 to form a nip. The pinching belt 613 is driven by the conveyance belt 603. A fragment of unwanted portion SHw cut off by the sheet cutting apparatus falls on the conveyance belt 603 and is conveyed in the direction of the arrow. The unwanted portion SHw conveyed by the conveyance belt 603 is pinched between the conveyance belt 603 and the pinching belt 613, which is the pinching member, and conveyed to the unwanted portion storage container 611.

A duct 607 is connected to the exhaust side of the fan 606. The duct 607 is connected to an exhaust port 608. The air including paper dust, sucked in from the suction ports 605 located near the first and second cutter units C1 and C2, is passed through the suction duct 604, the fan 606, and the duct 607, and discharged from the exhaust port 608. The suction duct 604, the fan 606, the duct 607, and the exhaust port 608 constitute a blowing unit that blows air so that airflow impinges on the unwanted portion SHw. The exhaust port 608 is arranged below and near the downstream end of the conveyance belt 603. The exhaust port 608 exhausts air in a direction generally parallel to the direction in which the belt unit 602 discharges the unwanted portion SHw. The airflow discharged from the exhaust port 608 in the direction of the hollow arrow prevents the unwanted portion SHw pinched in the nip between the conveyance belt 603 and the pinching belt 613 from hanging down long. When the trailing edge of the unwanted portion SHw passes the nip, the unwanted portion SHw falls into the unwanted portion storage container 611 with maintaining virtually horizontal orientation.

Figure 11:
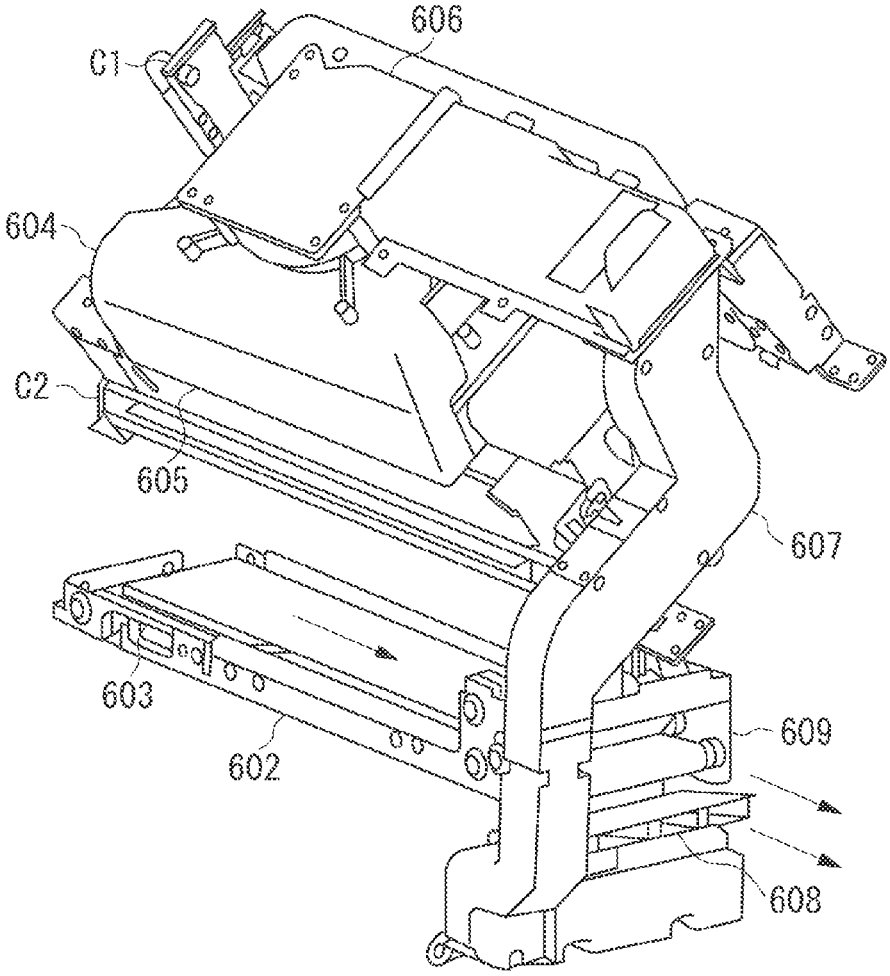
FIG. 11 is a schematic diagram illustrating the arrangement of only relevant parts extracted from the sheet cutting and conveyance unit.
Figure 12:
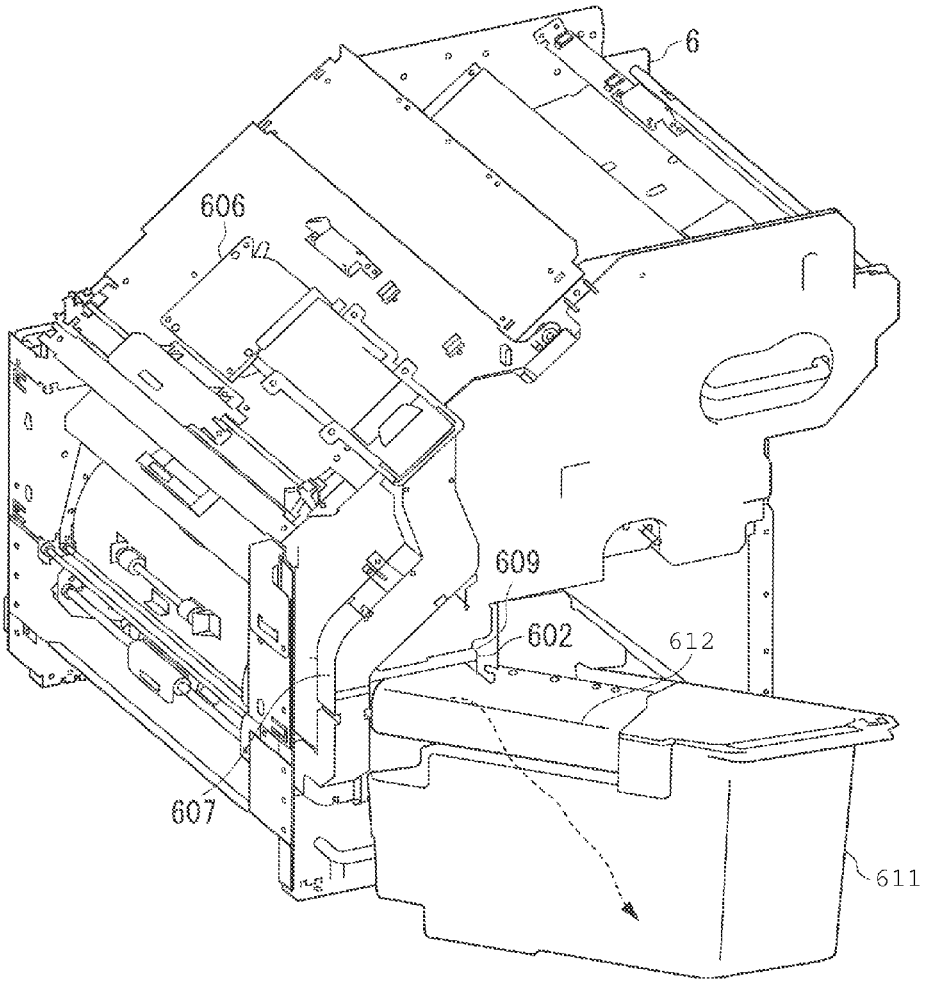
FIG. 12 is a schematic perspective view of the sheet cutting and conveying unit, which includes the sheet cutting apparatus, and an unwanted portion storage unit.

FIG. 11 is a schematic diagram illustrating the arrangement of only relevant parts extracted from the sheet cutting apparatus according to an exemplary embodiment. FIG. 12 is a schematic perspective view of the sheet cutting and conveying unit 6, which includes the sheet cutting apparatus according to an exemplary embodiment, and the unwanted portion storage container 611.

The unwanted portion storage container 611 is located adjacent to an unwanted portion discharge end 609 of the belt unit 602. Unwanted portions SHw are discharged to fall into the unwanted portion storage container 611. The exhaust port 608 discharges the air containing paper dust into the unwanted portion storage container 611. A guide 612 is positioned in the upper portion of the storage container 611 to facilitate discharging the unwanted discharge portions. The unwanted portion storage container 611 may be freely detachable from the sheet cutting apparatus to dispose of the contained unwanted portions SHw.

Figure 13:
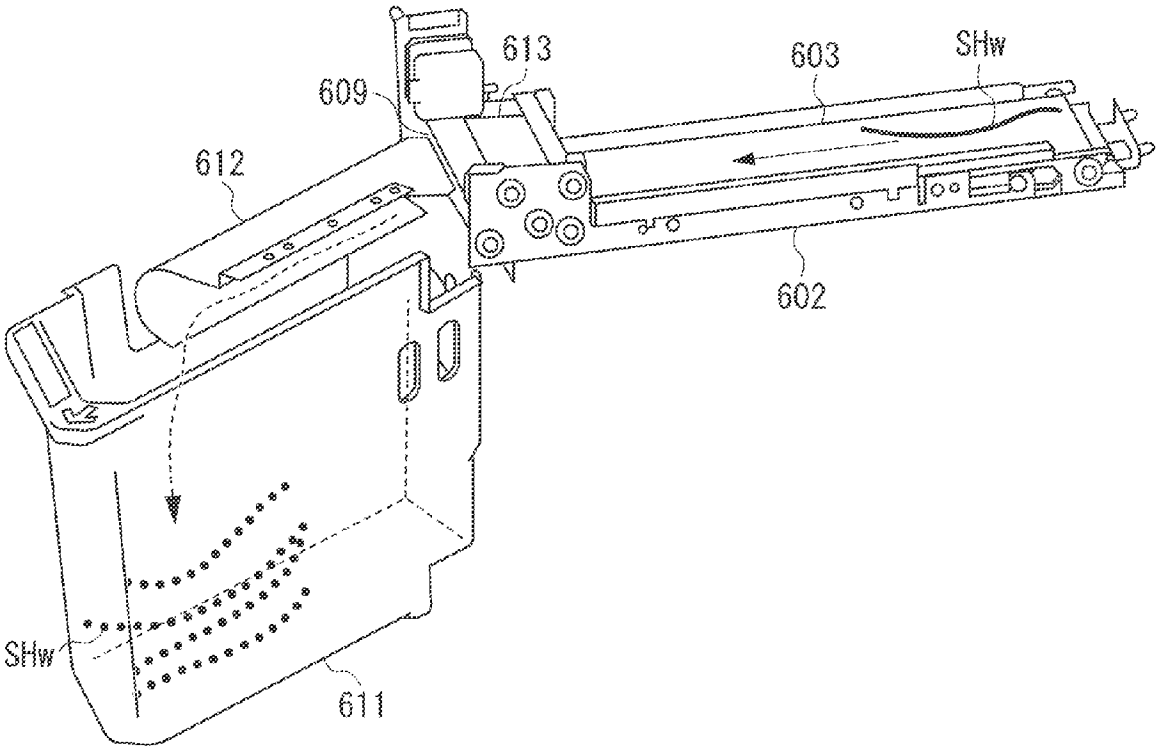
FIG. 13 is a schematic diagram illustrating the arrangement of only extracted relevant parts near the container for storing unwanted portions.

FIG. 13 is a schematic diagram illustrating the arrangement of only extracted relevant parts near the unwanted portion storage container 611 for storing unwanted portions SHw according to an exemplary embodiment. In FIG. 13, the unwanted portions storage container 611 is shaped like a parallelogram when seen from above. The unwanted portion storage container 611 is arranged oblique to the direction in which the belt unit 602 discharges unwanted portions SHw, and has a dimension greater than the sheet width. A guide 612 is arranged above the unwanted portion storage container 611. The guide 612 is attached to and supported by a structure (not illustrated) of the apparatus body. The unwanted portion discharge guide 612 is a semi-cylindrically-shaped member extending along a wall of the unwanted portion storage container 611. An unwanted portion SHw discharged from the belt unit 602 is longitudinally guided along the inner periphery of the semi-cylindrically-shaped member by the discharging force of the belt unit 602 and the force of the exhaust air from the fan 606. The unwanted portion SHw fully discharged from the belt unit 602 falls down along the circumferential direction and stored into the bottom of the unwanted portion storage container 611.

The semi-cylindrical guide 612 is arranged at the exit of the belt unit 602 and extends in the same direction as the longitudinal direction of the unwanted portion storage container 611. The bottom end of the semi-cylindrical guide 612 needs to be located vertically lower than the exit of the belt unit 602 so that unwanted portions SHw of even a soft sheet material can be guided to the semi-cylindrical guide 612 without fail.

The direction of the unwanted portion SHw discharged from the belt unit 602 is changed by the semi-cylindrical guide 612 which is situated oblique to the discharge direction. The unwanted portion SHw is thereby aligned to the longitudinal direction of the unwanted portion storage container 611, falls down, and deposits in the unwanted portion storage container 611.

The process in which the unwanted portion SHw discharged by the belt unit 602 changes its traveling direction from the discharged direction to the direction guided by the semi-cylindrical guide 612 will be described below.

Figure 14:
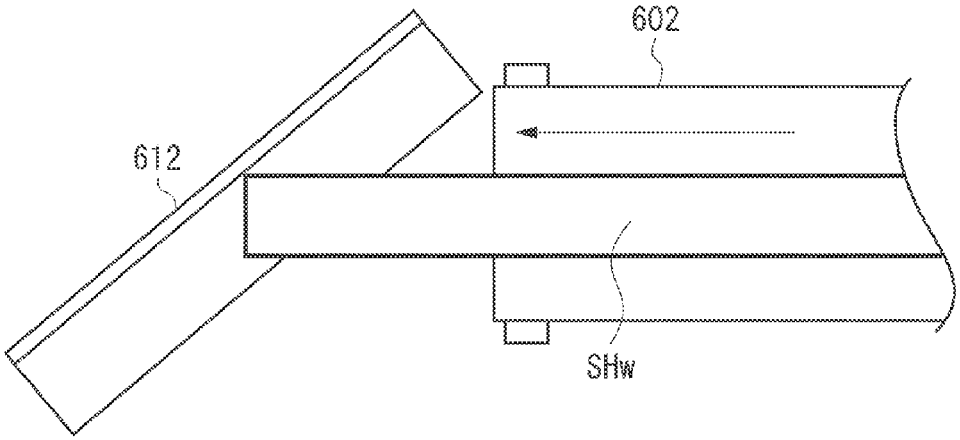
FIG. 14 is a schematic diagram illustrating the belt unit and a semi-cylindrical guide as seen from above.

FIG. 14 is a schematic diagram illustrating the belt unit 602 and the semi-cylindrical guide 612 as seen from above. In FIG. 14, the semi-cylindrical guide 612 is illustrated in a sectional view generally taken along the conveyance surface of the belt unit 602 (the top surface of the conveyance belt 603). A corner of the unwanted portion SHw conveyed by the belt unit 602 comes in contact with the inner periphery of the cylindrical part of the semi-cylindrical guide 612 which is arranged at an arbitrary angle to the conveyance direction of the conveyance belt 603.

Figure 15:
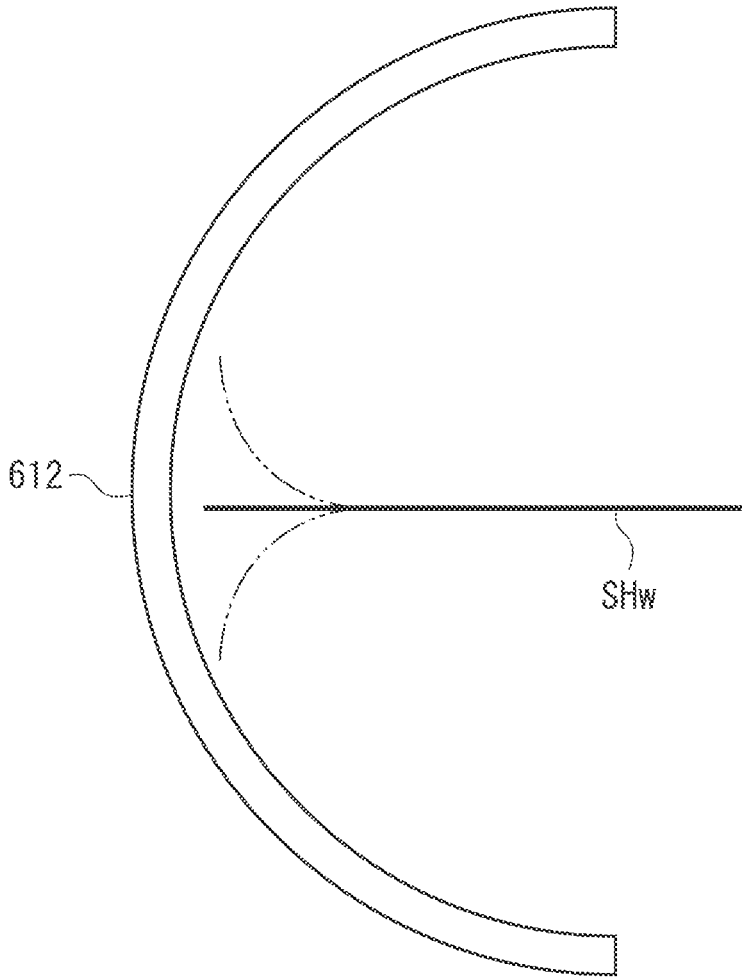
FIG. 15 is a schematic diagram illustrating an unwanted portion SHw in contact with the inner periphery of a cylindrical part of the semi-cylindrical guide.

The inner periphery of the cylindrical part of the semi-cylindrical guide 612 has a portion where the leading edge of the discharged unwanted portion SHw abuts on. FIG. 15 is a schematic diagram illustrating the unwanted portion SHw in contact with the inner periphery of the cylindrical part of the semi-cylindrical guide 612. The corner of the unwanted portion SHw in contact with the cylindrical part is guided in either one of the upper and lower directions which are illustrated by the double-dashed lines. With the corner of its leading edge guided in either one of the upper and lower directions, the unwanted portion SHw continues being conveyed by the belt unit 602. The unwanted portion SHw thus changes its traveling direction to twist along the inner periphery of the semi-cylindrical guide 612. To smoothly guide the unwanted portion SHw, the cylindrical part may be covered with a friction-reducing coating or a low friction sheet material.

Figure 16:
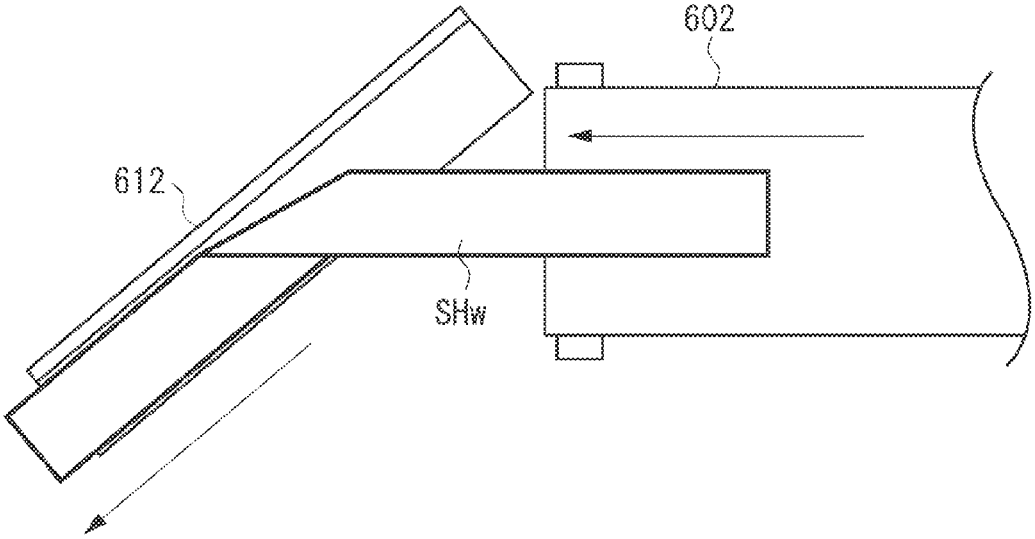
FIG. 16 is a schematic diagram illustrating the unwanted portion SHw whose direction is changed by the semi-cylindrical guide.

FIG. 16 is a schematic diagram illustrating the unwanted portion SHw whose direction is changed by the semi-cylindrical guide 612. In FIG. 16, the semi-cylindrical guide 612 is illustrated in a sectional view like FIG. 14. The unwanted portion SHw whose traveling direction has changed to the longitudinal direction of the semi-cylindrical guide 612 is conveyed by the conveyance force of the belt unit 602 until the trailing edge comes out of the belt unit 602. While the unwanted portion SHw is pinched in part in the nip between the conveyance belt 603 and the pinching belt 613 of the belt unit 602, the unwanted portion SHw is supported by the bottom portion of the inner periphery of the semi-cylindrical guide 612 from below. Once the trailing edge of the unwanted portion SHw comes out of the nip of the belt unit 602, the unwanted portion SHw falls and deposits into the unwanted portion storage container 611 in the orientation changed to the longitudinal direction similar to the semi-cylindrical guide 612. The unwanted portion storage container 611 has the same longitudinal dimension as that of the semi-cylindrical guide 612.

The semi-cylindrical guide 612 lies above the unwanted portion storage container 611. The unwanted portion storage container 611 and the semi-cylindrical guide 612 are desirably configured to be separable when disposing of unwanted portions SHw stacked in the container 611 to outside the sheet cutting apparatus. The semi-cylindrical guide 612 may be detachably attached to the top of the unwanted portion storage container 611.

According to the foregoing exemplary embodiment, no container needs to be arranged under the sheet cutting unit to store unwanted portions SHw. The space under the cutting unit can thus be used for the sheet conveyance route. This consequently allows miniaturization of the printer. The unwanted portion storage container 611 for storing unwanted portions SHw can also be increased in capacity. In addition, the capacity for collecting and storing unwanted portions SHw and paper duct can be maintained for a long period of time.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-232050 filed Oct. 21, 2011, which is hereby incorporated by reference herein in its entirety.

What is claimed is:

1. An apparatus comprising:

a cutting unit configured to cut a sheet;

a conveyance unit configured to convey an unwanted fragment of the sheet cut by the cutting unit in a conveyance direction away from the cutting unit;

a blowing unit configured to blow air to the unwanted fragment discharged from the conveyance unit; and wherein the blowing unit includes a suction port located over and opposite the cutting unit, a duct, and an exhaust port connected to the suction port via the duct, wherein the blowing unit sucks air including paper dust occurring during cutting of the sheet from the suction port and blows the air through the duct from the exhaust port to the unwanted fragment of the sheet, and wherein the exhaust port is located near a downstream end of the conveyance unit.

2. The apparatus according to claim 1, wherein the blowing unit blows air to the unwanted fragment discharged from the conveyance unit in a direction generally parallel to the conveyance direction from the exhaust port.

3. The apparatus according to claim 1, wherein the conveyance unit includes a first conveying belt and a second conveying belt, the first conveying belt conveys the unwanted fragment, and on a downstream side of the first conveying belt, the first conveying belt and the second conveying belt pinch the unwanted fragment of the sheet and discharge the unwanted fragment of the sheet.

4. The apparatus according to claim 1, further comprising a guide configured to guide the unwanted fragment discharged from the conveyance unit in a direction oblique to the conveyance direction and into the storage unit.

5. The apparatus according to claim 4, wherein the guide is configured to include, on a fragment-guiding surface, a portion that abuts a leading edge of the fragment and a portion that supports the fragment from below.

6. The apparatus according to claim 4, wherein the guide is a semi-cylindrically-shaped member, and wherein the blowing unit is configured to blow air to an inner periphery of the semi-cylindrically-shaped member.

7. The apparatus according to claim 6, wherein the inner periphery of the semi-cylindrically-shaped member includes a friction-reducing coating.

8. The apparatus according to claim 4, wherein the guide is detachably attachable to the storage unit.

9. The apparatus according to claim 1, further comprising a storage unit configured to store the unwanted fragment discharged from the conveyance unit, wherein the conveyance unit conveys the unwanted fragment of the sheet to the storage unit, and wherein the paper dust included in the air is exhausted to the storage unit.

10. The apparatus according to claim 9, wherein the storage unit is detachably attachable to the apparatus.

11. The apparatus according to claim 1, further comprising a second conveyance unit configured to convey a printing product of the sheet in a second conveyance direction different from the conveyance direction.

12. A printer configured to form images on a continuous sheet so that product portions and unwanted portions are alternately arranged and to cut off the unwanted portions to produce a final print product, the printer comprising:

an image forming unit configured to form images on the continuous sheet;

a cutting unit configured to cut off an unwanted portion from the continuous sheet on which the images are formed;

a conveyance unit configured to convey the unwanted portion cut off by the cutting unit in a conveyance direction away from the cutting unit; and a blowing unit configured to blow air to the unwanted portion discharged from the conveyance unit, wherein the blowing unit includes a suction port located over and opposite the cutting unit, a duct, and an exhaust port connected to the suction port via the duct, wherein the blowing unit sucks air including paper dust occurring during cutting of the sheet from the suction port and blows out the air through the duct from the exhaust port to the unwanted fragment of the sheet, wherein the exhaust port is located near a downstream end of the conveyance unit.

13. The printer according to claim 12, wherein the cutting unit is configured to include a first cutter unit and a second cutter unit arranged in a direction in which the sheet is conveyed, wherein the first cutter unit is configured to cut off a portion to be included in the final print product from the continuous sheet with the unwanted portion still continuous with the portion to be included in the final print product, wherein the second cutter unit is configured to cut off the unwanted portion from the portion to be included in the final print product, and wherein the conveyance unit discharges the unwanted portion cut off by the second cutter unit.

14. The printer according to claim 12, wherein the blowing unit blows air to the unwanted fragment discharged from the conveyance unit in a direction generally parallel to the conveyance direction from the exhaust port.

15. The printer according to claim 12, wherein the conveyance unit includes a first conveying belt and a second conveying belt, the first conveying belt conveys the unwanted portion, and on a downstream side of the first conveying belt, the first conveying belt and the second conveying belt pinch the unwanted portion of the sheet and discharge the unwanted portion of the sheet.

16. The printer according to claim 12, further comprising a guide configured to guide the unwanted portion discharged from the conveyance unit in a direction oblique to the conveyance direction and into the storage unit.

17. The printer according to claim 16, wherein the guide is detachably attachable to the storage unit.

18. The printer according to claim 12, wherein the blowing unit blows air to the unwanted portion discharged from the conveyance unit in a direction generally the same as the conveyance direction in which the unwanted portion is conveyed by the conveyance unit.

19. The printer according to claim 12, further comprising a storage unit configured to store the unwanted portions discharged from the conveyance unit, wherein the conveyance unit conveys the unwanted fragment of the sheet to the storage unit, and wherein the paper dust included in the air is exhausted to the storage unit.

20. The printer according to claim 19, wherein the storage unit is detachably attachable to the printer.

21. The printer according to claim 12, further comprising a second conveyance unit configured to convey a printing product of the sheet in a second conveyance direction different from the conveyance direction.

22. A method comprising:

cutting a sheet by a cutting unit;

conveying an unwanted fragment of the sheet cut by the cutting unit in a direction away from the cutting unit by a conveying unit; and blowing air to the unwanted fragment conveyed by the conveying unit, wherein, in the blowing, paper dust occurring during cutting of the sheet is sucked from a suction port located over and opposite the cutting unit and the sucked air including the paper dust is blown through a duct from an exhaust port connected to the suction port via the duct to the unwanted fragment of the sheet, wherein the exhaust port is located near a downstream end of the conveyance unit.

* * * * *